US006336387B1

(12) United States Patent
Lee

(10) Patent No.: US 6,336,387 B1
(45) Date of Patent: Jan. 8, 2002

(54) PLIER DEVICE HAVING AN EASILY ASSEMBLING STRUCTURE

(76) Inventor: Yung Jen Lee, P.O. Box 63-99, Taichung (TW), 406

( * ) Notice: Subject to any disclaimer, the term of this patent is extended or adjusted under 35 U.S.C. 154(b) by 0 days.

(21) Appl. No.: 09/761,020

(22) Filed: Jan. 11, 2001

(51) Int. Cl.[7] ..... B25B 7/02

(52) U.S. Cl. ..... 81/415; 81/416; 81/418; 81/423; 30/192

(58) Field of Search ..... 81/415, 416, 417, 81/418, 421, 422, 423, 385, 405, 407, 427.5, 342, 381, 383, 391; 30/260, 192; 7/128

(56) References Cited

U.S. PATENT DOCUMENTS 1,505,510 A * 8/1924 Uhl ..... 81/423
1,556,755 A * 10/1925 Burman ..... 81/423
2,109,147 A * 2/1938 Grosso ..... 81/418
2,507,710 A * 5/1950 Grosso ..... 81/418
3,742,957 A * 7/1973 White ..... 81/342
4,198,749 A * 4/1980 Nordin ..... 30/192
6,108,845 A * 8/2000 Hung et al. ..... 7/128
6,131,495 A * 10/2000 Chen ..... 81/416
6,250,184 B1 * 6/2001 Chang ..... 81/415

* cited by examiner

*Primary Examiner*—James G. Smith
*Assistant Examiner*—Jack Shaker

(57) ABSTRACT

A plier device includes a pair of handle levers pivotally secured together and each having a handle formed on one end and a stem formed on the other end. Two rods are secured to the stems respectively. A pair of jaws are pivotally secured together and each having a bar extended from one end. The bars each has a groove for receiving the rods of the stems. A spring member is engaged between the bars for biasing the bars to engage with the stems and for forcing the rods into the grooves of the bars, in order to secure the jaws to the handle levers without additional fasteners and tools.

1 Claim, 4 Drawing Sheets

PLIER DEVICE HAVING AN EASILY ASSEMBLING STRUCTURE

BACKGROUND OF THE INVENTION

1. Field of the Invention

The present invention relates to a plier device, and more particularly to a plier device including a plier member that may be easily assembled and secured to the handle member.

2. Description of the Prior Art

FIG. 1 shows a typical plier device including a handle member having two handles 80 pivotally secured at one end with a pivot shaft 81, and a plier member having two jaws 83 pivotally secured together at the middle portion 84 thereof and each having a groove 86 formed in one end thereof and facing toward the handles 80 for engaging onto the handles 80 with fasteners 82 or the like. The grooves 86 of the jaws 83 are facing toward the handles 80 such that the jaws 83 may be easily disengaged from the handles 80, and such that the jaws 83 are required to be secured onto the handles 80 with additional fasteners and/or additional tools.

The present invention has arisen to mitigate and/or obviate the afore-described disadvantages of the conventional plier devices.

SUMMARY OF THE INVENTION

The primary objective of the present invention is to provide a plier device including a plier member that may be easily assembled and secured to a handle member without additional tool members.

In accordance with one aspect of the invention, there is provided a plier device comprising a pair of handle levers including a middle portion pivotally secured together with a pivot shaft and each including a first end having a handle provided thereon and each including a second end having a stem provided thereon, a pair of jaws including a middle portion pivotally secured together with a pivot axle and each including a first end having a bar extended therefrom, and means for biasing the bars to engage with the stems and to secure the jaws to the handle levers without additional fasteners. The bars of the jaws may thus be easily and quickly biased and forced to engage with and to be secured to the stems of the handle levers without additional fasteners or tools. The plier device may thus includes two or more jaws or plier tool members changeably secured to the handle levers for allowing the tool members to be easily changed with each other.

The stems each includes a rod secured therein, the bars each includes a groove formed therein for receiving the rods of the stems. The grooves of the bars are facing away from each other.

The stems each includes a channel formed therein, the rods are extended through the channels of the stems respectively.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
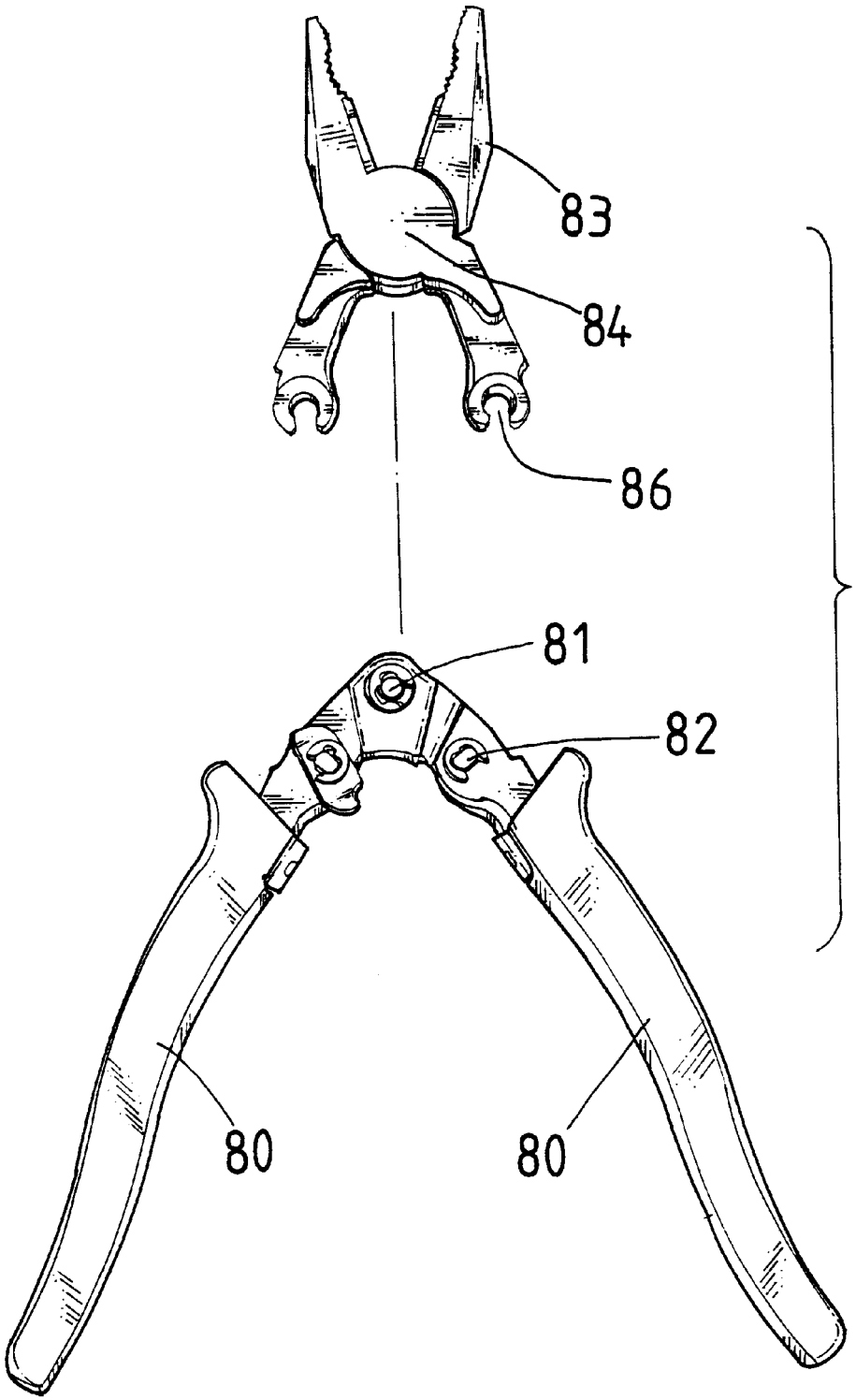
FIG. 1 PRIOR ART
FIG. 1 is an exploded view of a typical plier device.
Figure 2:
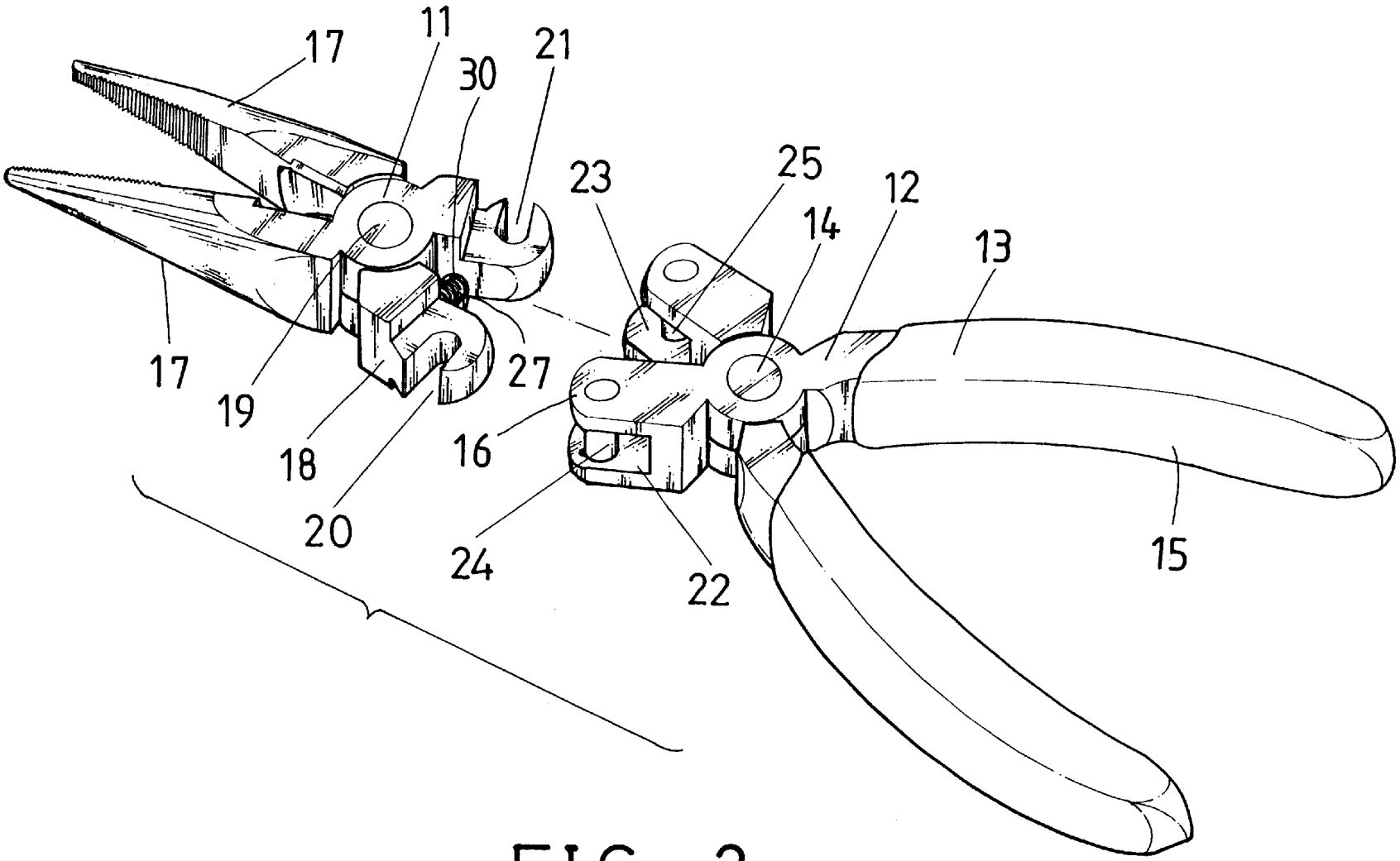
FIG. 2 is an exploded view of a plier device in accordance with the present invention.
Figure 3:
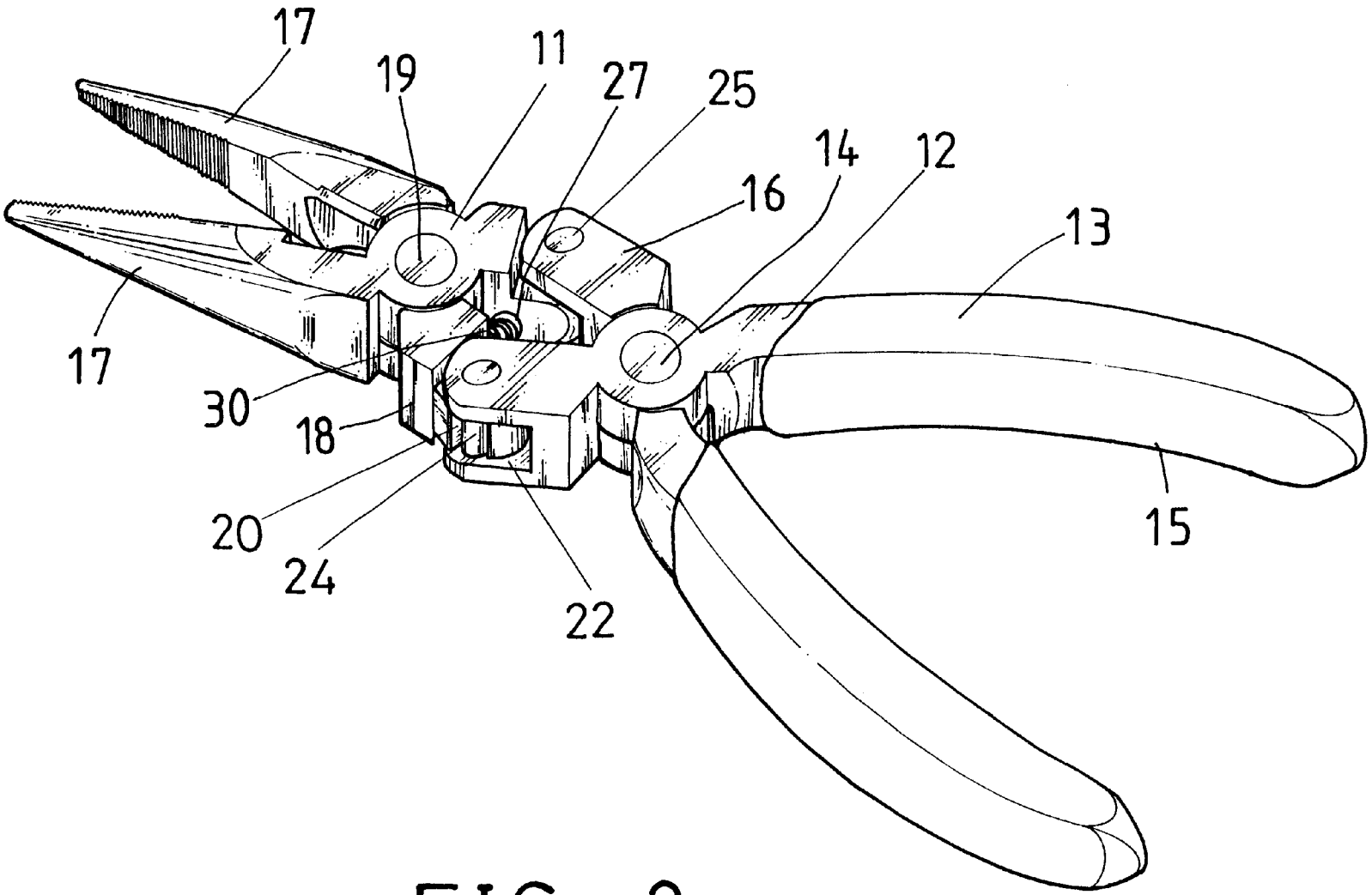
FIG. 3 is a perspective view of the plier device.

Referring to the drawings, and initially to FIGS. 2 and 3, a plier device in accordance with the present invention comprises a plier member 11 and a handle member 12 manufactured separately and to be assembled together. The handle member 12 includes two handle levers 13 pivotally secured together at the middle portion thereof with a pivot shaft 14, and each having a handle 15 formed or provided on one end thereof and each having a stem 16 formed or provided on the other end thereof. The stems 16 of the handle member 12 each includes a channel 22, 23 formed therein, and a rod 24, 25 secured therein and extended through the channel 22, 23 respectively.

The plier member includes two jaws 17 pivotally secured together at the middle portion thereof with a pivot axle 19 and each having a bar 18 extended from the other end opposite to the jaws 17. The bars 18 of the jaws 17 each includes a groove 20, 21 formed therein and facing away from each other for receiving the rods 24 of the handle member 12 respectively. The bars 18 of the jaws 17 each includes an orifice 27 formed therein for receiving a spring member 30 which is engaged between the bars 18 of the jaws 17 for biasing the bars 18 away from each other and thus for biasing the jaws 17 toward each other relatively.

Figure 4:
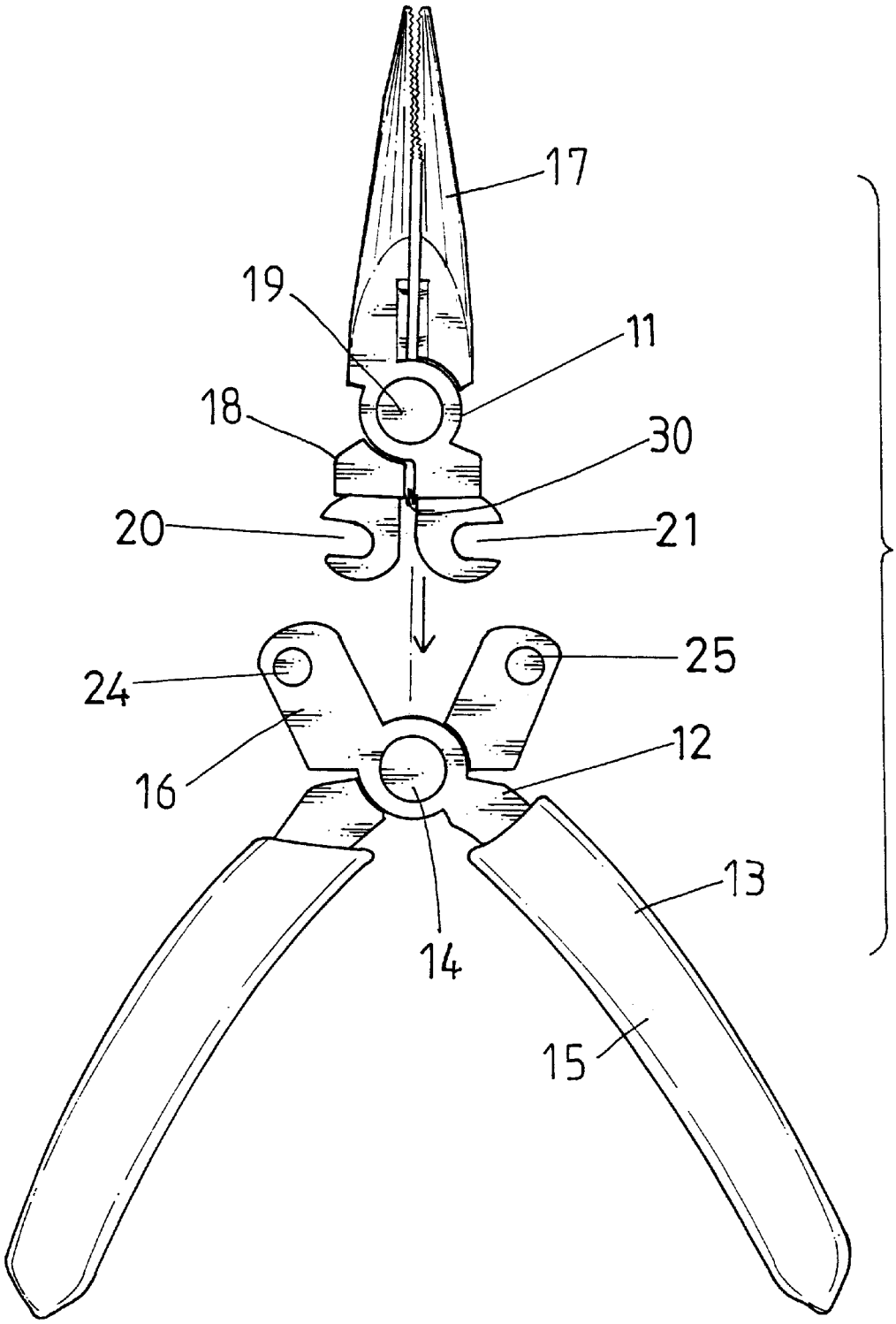
FIG. 4 is an exploded and plane view illustrating the assembling of the plier device.

In operation or in assembling the plier device, as shown in FIG. 4, the bars 18 may be forced toward each other against the spring member 30, for allowing the bars 18 to be engaged into the space formed between the stems 16 of the handle member 12 when the levers 13 or the handles 15 are moved away from each other. The rods 24, 25 may thus be easily engaged into the grooves 20, 21 of the bars 18, and the spring member 30 may bias the bars 18 of the jaws 17 to engage with the rods 24, 25 such that the plier member 11 may be easily and quickly assembled onto the handle member 12 without additional fasteners or tools. The plier device may includes two or more plier members 11 that may be changeably secured to the handle member 12 and that may be easily changed with each other.

Accordingly, the plier device in accordance with the present invention includes a plier member that may be easily assembled and secured to a handle member without additional tool members.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A Plier device comprising:

a pair of handle levers including a middle portion pivotally secured together with a pivot shaft and each including a first end having a handle provided thereon and each including a second end having a stem provided thereon, said stems each including a channel formed therein and each including a rod secured therein and extended in a direction parallel to said pivot shaft through said channels of said stems respectively, a pair of jaws including a middle portion pivotally secured together with a pivot axle and each including a first end having a bar extended therefrom, said bars each including a groove formed therein for receiving said rods of said stems, said grooves of said bars being facing away from each other, and means for biasing said bars to engage with said stems, and to force said rods to engage into said grooves of said bars to secure said jaws to said handle levers and moving said bars towards each other against an action of the biasing means to disengage said jaws from said handle levers without additional fasteners.

* * * * *